US008870134B2

(12) United States Patent
Catoni et al.

(10) Patent No.: US 8,870,134 B2
(45) Date of Patent: Oct. 28, 2014

(54) STABILISATION OF OBJECTS

(75) Inventors: John Gerard Catoni, Dunsborough (AU); Christopher Brian Heyring, Eagle Bay (AU); Toby William Heyring, Eagle Bay (AU); Richard Monk, Busselton (AU)

(73) Assignee: Tipstop Tables Pty Ltd, Eagle Bay (AU)

( * ) Notice: Subject to any disclaimer, the term of this patent is extended or adjusted under 35 U.S.C. 154(b) by 38 days.

(21) Appl. No.: 13/580,378

(22) PCT Filed: Feb. 25, 2011

(86) PCT No.: PCT/AU2011/000198
§ 371 (c)(1),
(2), (4) Date: Oct. 22, 2012

(87) PCT Pub. No.: WO2011/103628
PCT Pub. Date: Sep. 1, 2011

(65) Prior Publication Data

US 2013/0221170 A1 Aug. 29, 2013

(30) Foreign Application Priority Data

Feb. 26, 2010 (AU) ..... 2010900830

(51) Int. Cl.
*F16M 11/24* (2006.01)
*A47B 91/16* (2006.01)
*A47B 13/02* (2006.01)

(52) U.S. Cl.
CPC ..... *A47B 91/16* (2013.01); *A47B 13/02* (2013.01)
USPC ..... 248/188.2; 248/188.3; 108/155

(58) Field of Classification Search
USPC ..... 248/188, 188.1, 188.2, 188.6, 188.7, 248/188.91, 188.3; 108/153.1, 154, 155, 108/157.1, 158.11
See application file for complete search history.

(56) References Cited

U.S. PATENT DOCUMENTS

| | | | | |
|---|---|---|---|---|
| 3,157,248 | A * | 11/1964 | Nesslinger et al. | 182/152 |
| 5,690,303 | A | 11/1997 | Winters | |
| 5,823,595 | A * | 10/1998 | Tronco | 296/26.03 |
| 7,503,266 | B2 * | 3/2009 | Carter | 108/115 |
| 7,775,587 | B1 * | 8/2010 | Reed | 297/35 |
| 8,607,715 | B2 * | 12/2013 | Catoni et al. | 108/150 |
| 2006/0249637 | A1 * | 11/2006 | Houldsworth | 248/166 |
| 2010/0071599 | A1 * | 3/2010 | McEntire | 108/50.11 |
| 2013/0000529 | A1 * | 1/2013 | Heyring et al. | 108/147.22 |

FOREIGN PATENT DOCUMENTS

| | | | | |
|---|---|---|---|---|
| CA | 2216869 | | 3/1999 | |
| FR | 2607878 | A1 | 6/1988 | |
| FR | 2902619 | A1 | 12/2007 | |
| GB | 172195 | A * | 12/1921 | A47B 91/16 |
| WO | 2007041725 | A1 | 4/2007 | |

OTHER PUBLICATIONS

Extended Search Report dated Dec. 12, 2013 by European Patent Office, for EP Application 11746755.5; PCT/AU2011/000198.

* cited by examiner

*Primary Examiner* — Alfred J Wujciak
(74) *Attorney, Agent, or Firm* — Cascio & Zervas

(57) ABSTRACT

A support mechanism (7) for an object, such as a table, has at least two fixed legs (3 and 5), at least two moveable legs (4 and 6) and an interconnection means (8). The interconnection means is intermediate and rigidly connected to the at least two fixed legs. Each moveable leg includes a beam portion (4*a*, 6*a*), with one end of the beam portion connected to the interconnection means by a pivot having a pivot axis (provided by the bolt 12 for example). Each moveable leg also includes at least one support member (19-22) connected to and extending from the beam portion. At least one object support portion (19*b*-22*b*) is provided on each support member, the object support portion in contact with the object (such as the underside of a table top) in use and providing a substantially vertical support force to the object. Locating means (14) attached to the object and located relative to the interconnection means, permit upward relative displacement between the locating means and the interconnection means and prevent substantially horizontal relative displacement between the locating means (14) and the interconnection means (8). Substantially vertical displacement of the ground engaging end or foot (4*c* or 6*c*) of one of the moveable legs relative to the fixed legs causes substantially vertical displacement of the support member of the associated moveable leg and therefore substantially vertical displacement of the object and the locating means relative the interconnection means and the fixed legs, causing another of the at least two moveable legs to rotate, the support mechanism thereby conforming to an uneven surface. Relative horizontal motion between the support members and the object can be accommodated by adding a degree of freedom such as using sliding joints or flexible support members.

17 Claims, 4 Drawing Sheets

STABILISATION OF OBJECTS

FIELD OF THE INVENTION

The present invention relates to the stabilisation of objects, such as freestanding furniture and appliances.

BACKGROUND OF THE INVENTION

Many objects such as items of furniture (i.e. tables, chairs and benches) and white goods are supported at at least four points of contact with the ground or floor (e.g. using ground engaging means such as legs, feet or wheels). These objects are used in a wide range of situations and in many cases the surface on which the object is stood is uneven or not a perfectly flat plane. To prevent, for example, furniture from rocking on an uneven surface it is common for small tables or stools to use three legs since three points are sufficient to define a linear plane and therefore provide location of the object without rocking. However, there are many reasons why three legs are undesirable on many objects, particularly those having a quadrilateral shape in plan view such as square or rectangular topped tables where four legs are generally preferred, located towards each corner. The use of four or more legs of equal length rigidly attached to and supporting a flat table top restricts the feet of the table to lie in a flat plane, so they are unable to all contact the ground simultaneously when the surface is uneven. This causes the table to be unstable and rock, which is most noticeable in four-legged tables with small table tops.

There are numerous applications requiring a support mechanism that is uncomplicated and robust, but can have four or more legs which adapt to uneven surfaces to provide stability.

BRIEF DESCRIPTION OF KNOWN ART

In U.S. Pat. No. 3,814,362, a table is shown having four L-shaped legs with the vertical portion of each leg located towards the centre of the table, two adjacent legs are fixed to each other and the table top. The other pair of adjacent legs are fixed to each other and pivotally connected to the lower end of the vertical portion of the fixed pair of legs such that relative rotation about the pivot provides adjustment of the four feet to uneven surfaces. The relative rotation is permitted or locked by additional mechanisms. However, the relative rotation of the pairs of legs can provide a misaligned or unattractive look to the table and user intervention is required to operate the additional locking mechanisms.

French Publication Numbers 2 902 619 and 2 902 620 show mechanisms to permit vertical displacement of the four corner legs of a square or rectangular table. The arrangements disclosed maintain the angle of each leg perpendicular to the table top (which is very good for aesthetics) even when the legs have displaced to contact a very uneven surface. However, the linkages used involve an excessive quantity of individual links and joints making them complex and either heavy or fragile.

Canadian Patent Application Number 2,216,869 shows a flexible base for rolling chairs and workstools. Each castor is mounted at the lower end of a T-shaped arm 14, the arm 14 being able to rotatably fixed to the base about axis 24 (along the top bar of the T). Additional T-shaped bridge elements 26 are utilised which can pivot relative to the base about axis 34 (along the vertical bar of the T), the ends of the top bar engaging the T-shaped arms 14 of adjacent castors. Thus the mechanism permits vertical displacement of adjacent castors in opposing vertical directions to maintain contact with uneven surfaces, thereby preventing rocking and providing stability. However, the arrangement is complex having a large number of parts and a large number of joints.

It is therefore a preferred object of the invention to provide a support mechanism having four or more legs which can adapt to uneven surfaces utilising an uncomplicated mechanism.

It is a preferred object of the invention that the mechanism self adjust to the uneven surface without requiring operator intervention.

It is an optional object of the invention to provide a travel stop to limit excess articulation of the mechanism without requiring operator intervention.

SUMMARY OF THE INVENTION

With this in mind, according to one aspect of the present invention, there is provided a support mechanism for an object, the support mechanism including at least two fixed legs, at least two moveable legs and an interconnection means, each leg including a ground engaging means. The at least two moveable legs are moveable relative to the fixed legs and the interconnection means. The at least two fixed legs together include a first and a third leg, the interconnection means being intermediate and rigidly connected to the at least two fixed legs. The at least two moveable legs together include a second and a fourth leg, each moveable leg including a beam portion, one end of the beam portion being connected to the interconnection means by a pivot having a pivot axis. Each moveable leg further includes at least one support member connected to the beam portion and extending from the beam portion, at least one object support portion being provided on each support member, in use the object support portion being in contact with the object and providing a substantially vertical support force to the object. Locating means are attached to the object and located relative to the interconnection means to permit (preferably slidable) relative displacement between the locating means and the interconnection means in a substantially upward direction (relative to the interconnection means) and to prevent relative displacement between the locating means and the interconnection means in a substantially horizontal direction (relative to the interconnection means), such that substantially vertical displacement of the ground engaging means of one of the moveable legs relative to the fixed legs causes substantially vertical displacement of the support member of the associated moveable leg and therefore substantially vertical displacement of the object and the locating means relative the interconnection means and the fixed legs, causing the other of the at least two moveable legs to rotate (about its pivot point), the support mechanism thereby conforming to an uneven surface.

The support mechanism provides support and conforms to an uneven surface (to prevent rocking or instability) inherently or automatically, requiring no additional operator intervention. If only four legs are provided, the load on each leg is substantially unaffected by the magnitude of warp of the uneven surface.

The at least one support member may extend laterally from the beam portion.

The interconnection means may include a substantially vertical sleeve and the locating means may include a substantially vertical protrusion or spigot slidably received in the sleeve. Alternatively, the interconnection means may include a substantially vertical protrusion and the locating means may include a substantially vertical sleeve slidably located around the protrusion of the interconnection means.

Each support member may be flexible in a substantially horizontal direction to accommodate relative lateral motion between the object and the beam portion of an associated leg (preferably substantially parallel to a major axis of the beam portion and perpendicular to the pivot axis of the beam portion pivot), and wherein each support member may be substantially rigid in a vertical direction to provide support of the object relative to the beam portion. Alternatively, motion of each object support portion relative to the object may be permitted in a lateral direction perpendicular to the pivot axis of the respective leg and limited in a lateral direction parallel to the pivot axis of the respective leg by a pin and slot mechanism. In this case, the support members may be substantially rigid.

A travel limit may be provided between the object support portion of each support member and the object, the travel limit being defined by at least one end of the slot of the pin and slot mechanism, thereby limiting the rotation of at least one moveable leg and providing a travel limit to the support mechanism. Alternatively or additionally, a travel limit may be provided between the interconnection means and the locating means to provide a physical limit to the relative displacement between the locating means and the interconnection means in a substantially vertical direction, thereby limiting the rotation of each moveable leg and limiting warp travel. For example the protrusion may extend through the end of the sleeve, the protrusion including a step which interferes with the end of the sleeve at the desired travel limit point. Similarly a pin may be provided on either the sleeve part or the protrusion part, the pin sliding in a slot in the other part with the end of the slot being positioned to interfere with the pin at the desired maximum travel position to provide the limit stop.

At least one leg may include a portion which interferes with the object when warp displacement of the mechanism exceeds a predefined magnitude, said interference providing a travel limit, limiting the maximum articulation of the support mechanism. That portion may be the beam portion of the leg, or a protrusion or additional portion provided specifically as a travel limit.

Each leg may include a downwards extending portion, extending downwards to the respective ground engaging means.

Each fixed leg may include a beam portion which can include a first end and a second end, the first end of the first and third legs being fixed to the interconnection means, the first end of the second and fourth legs being connected to the interconnection means by the pivot.

The beam portion of each leg may be substantially horizontal in use.

The second end of the beam portion of each leg may be connected to the ground engaging means and the at least one support member of each moveable leg may be connected to the beam portion of the respective moveable leg between the first and second ends. Alternatively, the second end of the beam portion of each moveable leg may be connected to the at least one support member of the respective moveable leg and the ground engaging means may be connected between the first and second ends of the beam portion of the respective moveable leg. The support members may not extend perpendicular to the beam portions in plan view, but the position of a line through the top support portions parallel to the pivot axis of the respective moveable leg can be considered the effective position of the support member.

The beam portions of the first and third legs may be substantially parallel to each other in use. The second and fourth leg beam portions may be substantially parallel to each other and substantially perpendicular to the first and third leg beam portions in plan view.

The beam portions of the legs may form a cross in plan view. The pivot axes of the second and fourth legs may be parallel to the beam portions of the first and third legs in plan view.

The object may be a table top. For example, the top support portions may be in contact with a table top, i.e. the object being supported is a table top. The object could alternatively be a piece of furniture or part of a piece of furniture, or any other object including white goods.

One or more forms of the present invention may provide a table including a table top and first, second, third and fourth legs, the first and third legs being fixed to an interconnection means, the second and fourth legs including a beam portion, the beam portions of the second and fourth legs being connected to the interconnection means by a respective pivot having a pivot axis, each leg including a downwards extending portion, extending downwards to a respective ground engaging means.

the second and fourth legs each including at least one respective support member connected to the respective beam portion and extending at least laterally from the beam portion, at least one top support portion being provided on each support member, the top support portion providing a substantially vertical support force to the table top, locating means fixed to the table top and slidably located relative to the interconnection means to permit relative displacement between the locating means and the interconnection means in a substantially vertical direction (relative to the interconnection means) and to prevent relative displacement between the locating means and the interconnection means in a substantially horizontal direction (relative to the interconnection means).

Using this arrangement, the legs of the table are thereby able to conform to uneven surfaces and support forces are transferred between the four legs such that the load on each leg is substantially unaffected by the magnitude of warp of the uneven surface.

It will be convenient to further describe the invention by reference to the accompanying drawings which illustrate preferred aspects of the invention. Other embodiments of the invention are possible and consequently particularity of the accompanying drawings is not to be understood as superseding the generality of the preceding summary of the invention.

DESCRIPTION OF PREFERRED EMBODIMENT

Figure 1:
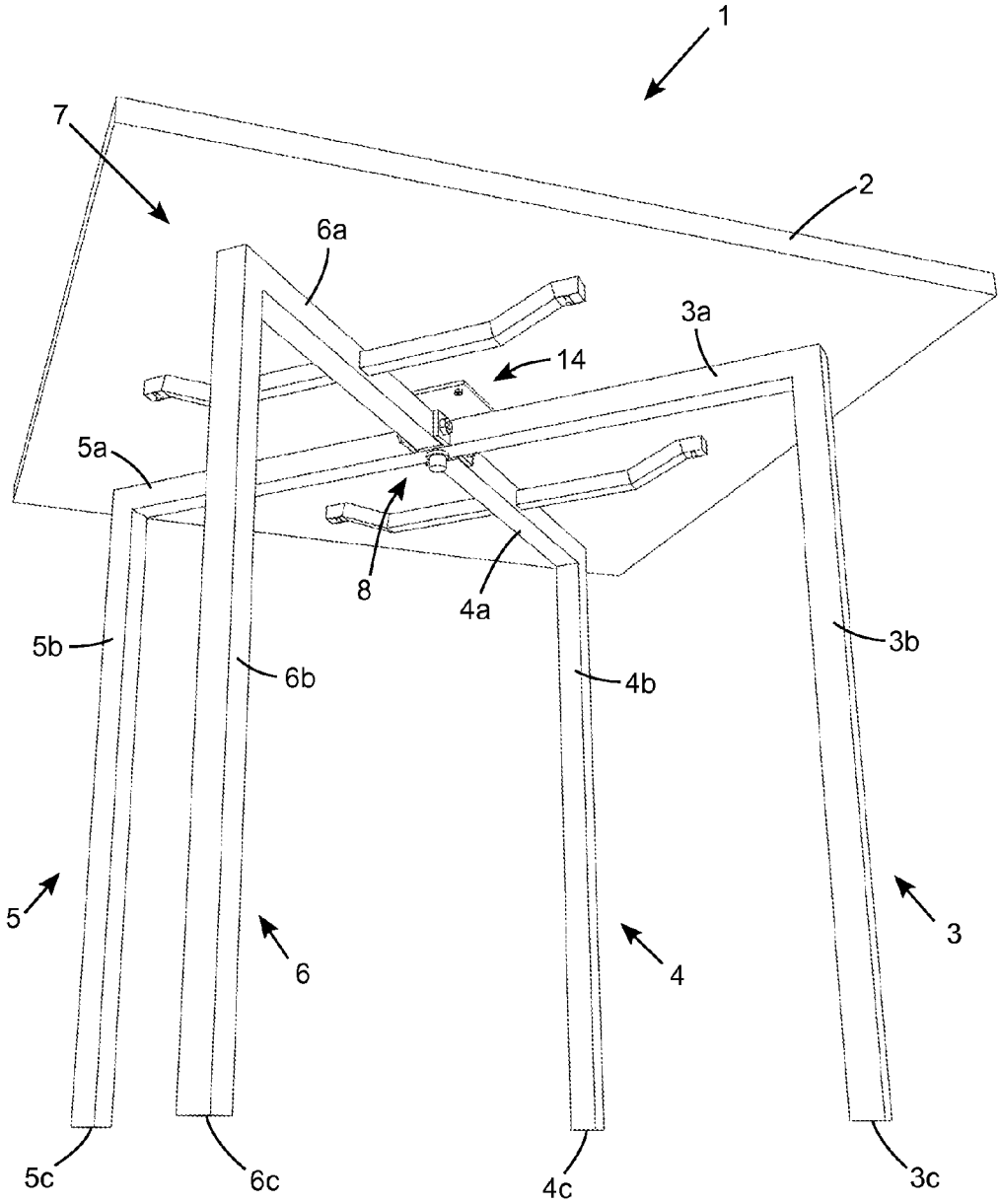
FIG. 1 is a perspective view of a first possible embodiment of the present invention.

Referring initially to FIG. 1 there is shown a table 1 with a table top 2 and four legs 3, 4, 5 and 6, the table incorporating a self-adjusting mechanism 7 to enable each leg to maintain contact with a ground surface even when the surface is uneven. Each leg includes a beam portion (3*a*, 4*a*, 5*a* or 6*a*) from the outer end of which extends a downwards extending portion (3*b*, 4*b*, 5*b* or 6*b*). The lower end of the downwards extending portion incorporates a ground engaging means (3*c*, 4*c*, 5*c*, 6*c*), in this case formed as a integral part of the leg, although separate ground engaging means can be used which can enable the contact point of each leg with the ground to be suited to a particular application (eg different shapes, materials and fixings).

Figure 2:
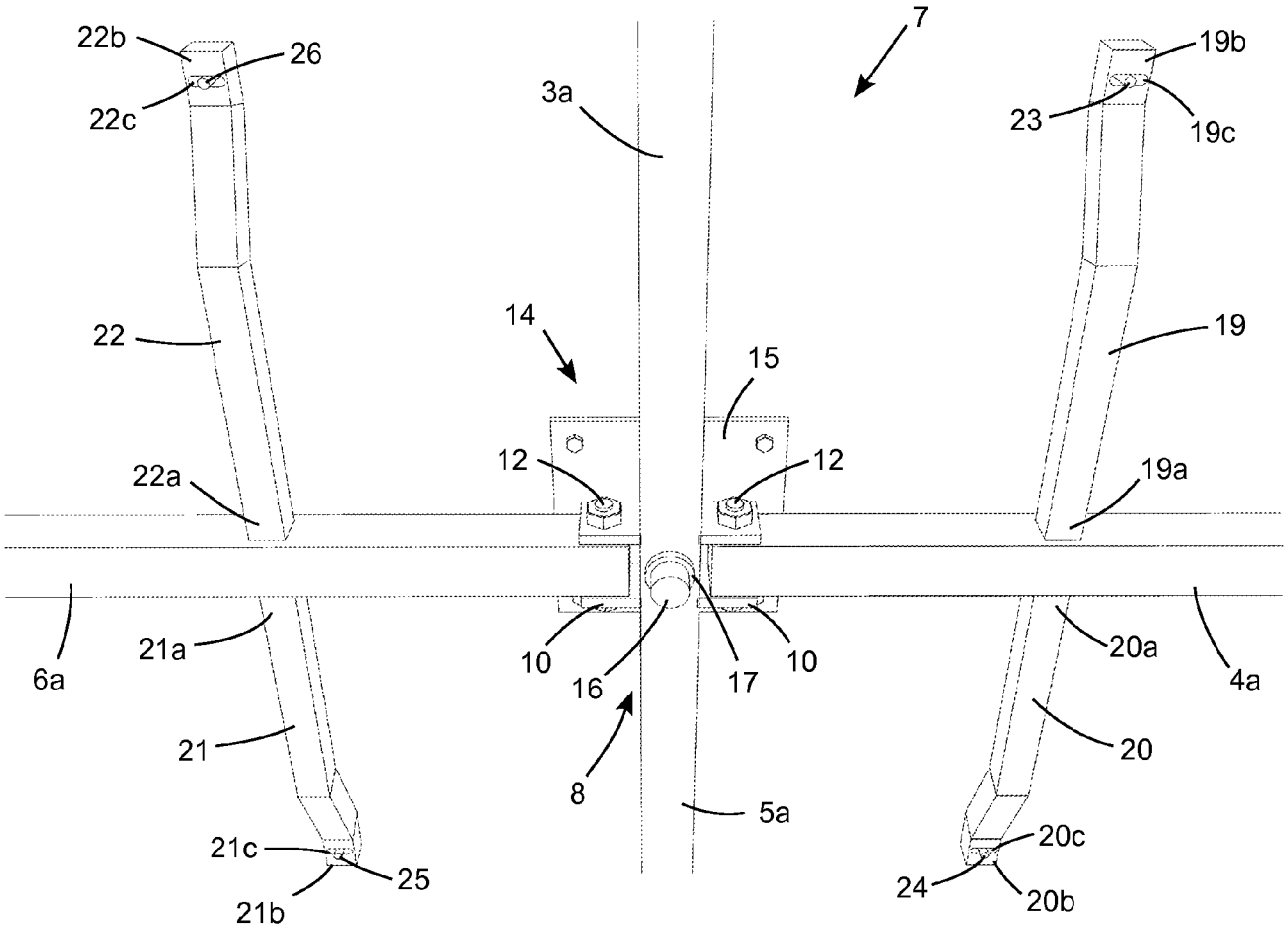
FIG. 2 is a detailed view of the mechanism of the first possible embodiment.

FIG. 2 shows the support mechanism 7 of FIG. 1 in more detail. An interconnection means 8 interconnects the legs. Two legs (3 and 5) are fixed legs, rigidly connected to the interconnection means and two legs (4 and 6) are moveable legs, pivotally connected to the interconnection means. In FIGS. 1 and 2 the beam portions 3*a* and 5*a* of the fixed legs are aligned with each other and are joined with a intermediate beam, so all three aligned beams can be one piece of extruded tube for example. However the intermediate beam is part of the interconnection means, which further includes tabs 10 extending laterally from the beam, the tabs locating bolts 12 providing the pivot axis of each pivot connecting the moveable legs 4 and 6 to the interconnection means 8.

Although the interconnection means does not provide direct vertical support to the table top, it does provide some lateral location. For this purpose, a locating means 14 is provided including a plate 15 fixed to the table top and a vertical spigot 16 received in a vertical hole or sleeve 17 in the interconnection means 8. The spigot 16 of the locating means can slide vertically in the sleeve 17 of the interconnection means, so vertical translation of the locating means (and the table top) relative to the interconnection means (and the fixed legs) is permitted, but lateral translation is prevented. The spigot can be any protrusion fixed to the plate (or at least a rigid part of the locating means) providing the functionality described above, ie it could be a square section rather than a round section, and it could be solid or hollow. The spigot or protrusion could alternatively be provided on the interconnection means and the hole or sleeve could then be provided as part of the locating means.

The table top is supported vertically by support members 19 and 20 extending from the beam portion 4*a* of moveable leg 4 and by support members 21 and 22 extending from the beam portion 6*a* of moveable leg 6. One end of each support member 19*a*, 20*a*, 21*a* or 22*a* is rigidly connected to a beam portion (4*a* or 6*a*) and the other end includes a table top support portion 19*b*, 20*b*, 21*b* or 22*b* which is connected to the underside of the table top 2. These top support portions 19*b*, 20*b*, 21*b*, 22*b* provide the vertical forces supporting the table top, these forces being transmitted by the rigid support members to the beam portions of the moveable legs 4 and 6. Taking the example of moveable leg 4, the forces from the support members 19 and 20 acting on the beam portion 4*a* are reacted by a combination of the force at the ground engaging portion of the leg and the force at the pivot of the leg through bolt 12. If the top support portions 19*b* and 20*b* lie on a line perpendicular to the mid point of a line between the ground engaging means and the bolt in plan view, the other moveable arm is of the same proportions and the ground engaging means form a square footprint in plan view, then the loads from the table top will be shared equally between all four ground engaging means (if the load on the table top is central) or at least the combined load at the ground engaging means of the two moveable legs will be equal to the combined load at the ground engaging means of the two fixed legs (even if the load on the table top is eccentric). Due to the articulation feature of the mechanism, allowing the legs to conform to a warped ground surface, this load distribution will remain substantially unchanged when the table is placed on an uneven surface.

If for example the ground engaging means 6*c* of one of the moveable legs were displaced vertically upwards with respect to the fixed legs, then the leg 6 would rotate about the bolt 12 and the support members 21 and 22 would be displaced a proportional distance upwards, causing the table top 2 to be displaced upwards relative to the fixed legs and the interconnection means. The rotation of the leg 6 causes not only a vertical displacement of the support members 21 and 22, but a lateral displacement of the support members relative to the interconnection means. The spigot 16 of the locating means 14 ensures that the table top does not translate horizontally relative the interconnection means, so a slot 21*c* and 22*c* is provided in each top support portion to accommodate the lateral displacement of the support members relative the interconnection means (and the table top). The pins 25 and 26 are fixed to the table top through the slots and can be simple screws, the heads of the screws ensuring that when the table is lifted, the mechanism stays attached. Similar pins 23 and 24 are provided in slots 19*c* and 20*c* of the support members on the other moveable leg 4. The vertical displacement of the table top relative the fixed legs and interconnection means drives a similar rotation of the other moveable leg 4 so that the ground engaging means 4*c* moves in the same vertical direction as 6*c*.

The length of at least one slot can be limited to limit the displacement of one moveable leg relative to the fixed legs in at least one direction to provide a travel limit or stop to limit the articulation or magnitude of warp of the mechanism. If any slot is to be used as a travel limit, then preferably each slot is used to distribute the limit loads through the mechanism, reducing mechanical stresses. An optional travel limit can alternatively or additionally be provided through interference between portions of the legs and the table top. For example, where the beam portions of each leg extend out to downwards leg portions near the corners of the table top, the outer end of each beam portion could be designed to contact the table top at a given magnitude of warp or articulation of the mechanism. The downwards extending portions of the legs could be extended upwards or specific protrusions or portions could be provided to contact the table top as required.

Figure 3:
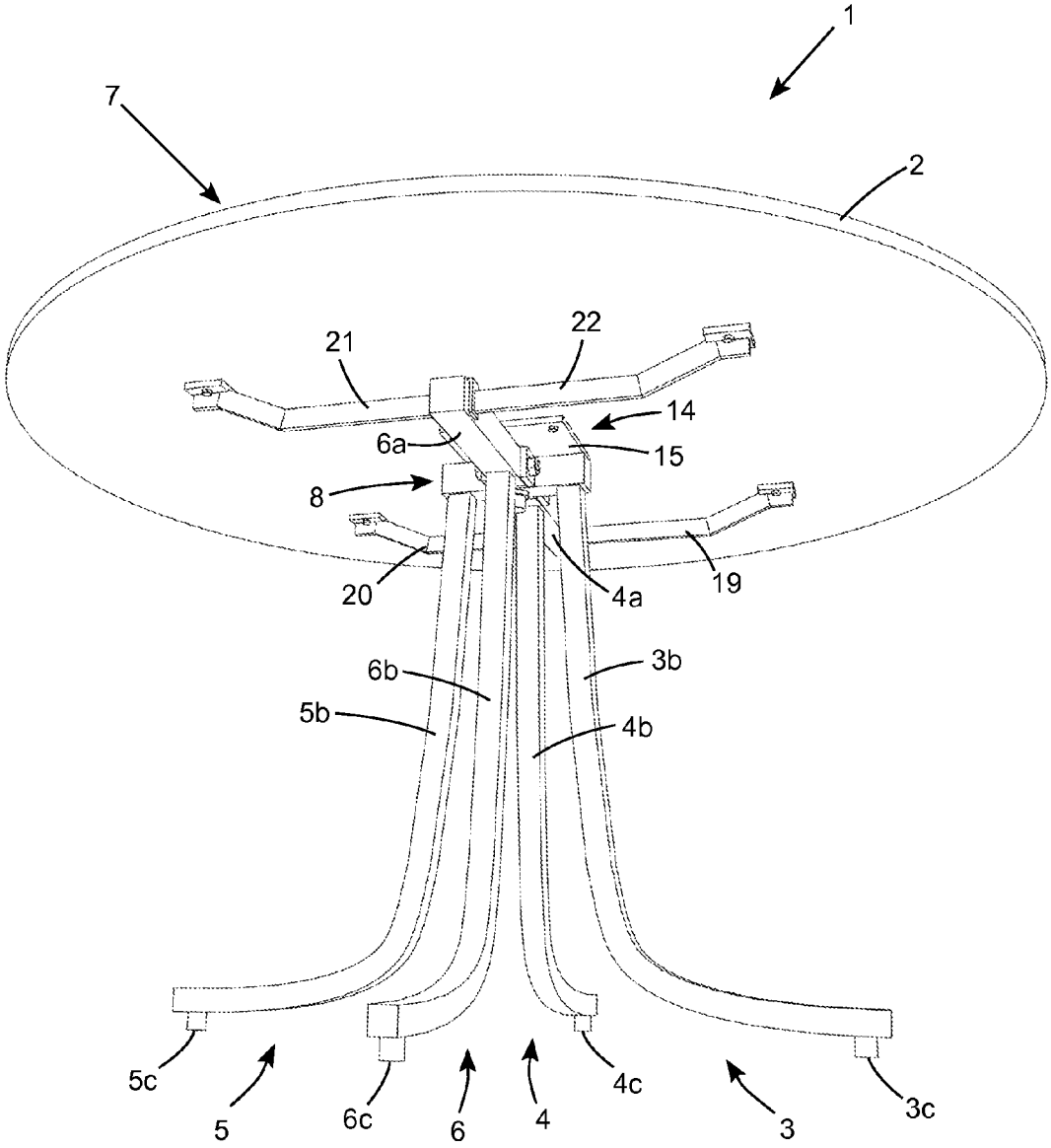
FIG. 3 is a perspective view of a second possible embodiment of the present invention.

FIG. 3 shows a table incorporating a similar mechanism to that in FIGS. 1 & 2, but includes several detail variations. Equivalent parts are given like reference numerals to the earlier figures.

The table top 2 is round instead of square although any shape of table top can be used with the invention. The legs extend downwards from near the centre of the table, the fixed legs 3 and 5 have minimal or no beam portion, being fixed to the interconnection means 8. However the moveable legs 4 and 6 still incorporate a beam portion 4*a* or 6*a* to which the support members are mounted.

The ground engaging means (or feet) 3*c*, 4*c*, 5*c*, 6*c* feet can again be integrally formed into each leg. Alternatively each foot can be separate and fixed to the leg by any known means such as press fit, screw fit, welding, bonding or by a joint such as a ball joint to allow the foot to adjust to motions of the leg and cambers of the floor or other ground surface. Each foot can be flat, rounded or any other profile and be made from any suitable materials (eg soft materials to protect delicate floors).

Figure 4:
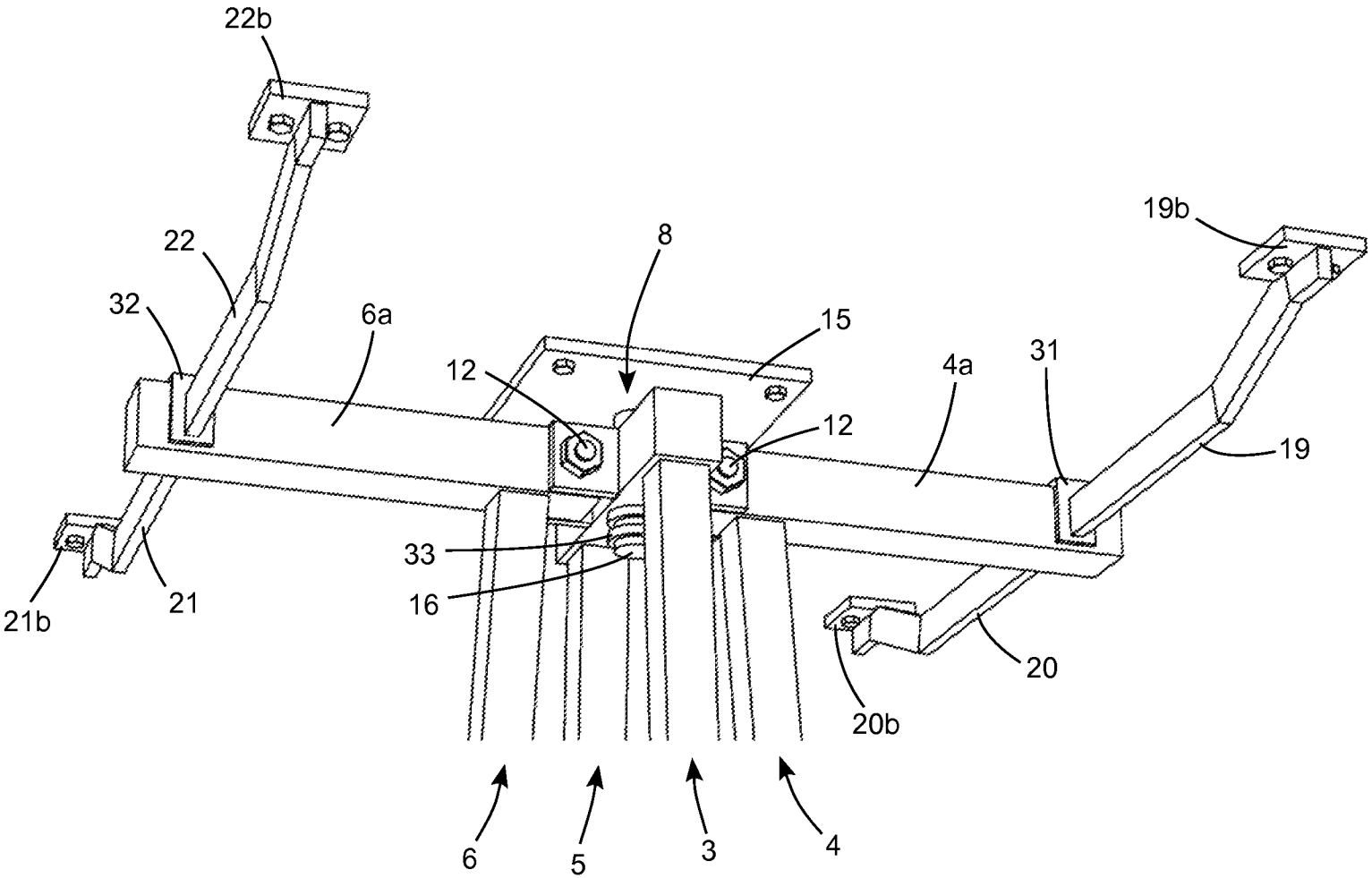
FIG. 4 is a detailed view of the mechanism of the second possible embodiment.

FIG. 4 is a detailed view of the mechanism under the table top of FIG. 3. The support members on each moveable leg are combined into a respective single part. For example, the support members 19 and 20 on moveable leg 4 are interconnected by a saddle part 31. This saddle part is fixed to the beam portion 4*a* of the moveable leg 4, making the support members easily removable for "flat pack" shipping. The support members 21 and 22 on moveable leg 6 are interconnected by a similar saddle part 32, which can be formed as one piece with the support members, for example by fabrication or moulding.

The support members 19, 20, 21 and 22 are also flexible to remove the need for the pin and slot (or equivalent) type joint between the top support portions (19*b*, 20*b*, 21*b*, 22*b*) and the table top. The support members need to be stiff in a vertical direction to provide support of the table top, but flexible in a substantially horizontal direction perpendicular to the pivot axis of the leg pivot through bolt 12. To this end the support members shown in FIGS. 3 and 4 have a tall narrow profile. The support members can be moulded from a plastic for example, and can be rigidly connected to the table top.

Alternatively, the support members could be stiff as in FIGS. 1 and 2, but rigidly fixed to the table top, with slots (to provide relative horizontal motion between the table top and the respective moveable leg) being provided between the support members (or saddle part of interconnected support members) and the beam portions.

The support members can have any shape and do not need to extend perpendicular (in plan view) to the beam portion of the associated leg, nor extend parallel to the pivot axis of the associated leg. For example, the beam portion 6*a* and the support members 21 and 22 of FIGS. 3 and 4 form a T shape in plan view, but they could equally form a Y or V shape if the support members connect to the beam portion nearer the pivot through bolt 12. The beam portion 6*a* can then be reduced in length. The most import aspect of the geometry is that the distance in plan view between the pivot axis and the top support portions is the required proportion of the distance in plan view between the pivot axis and the ground engaging means. As discussed previously, this proportion is preferably half to distribute loads equally between the ground engaging means of the moveable legs versus the ground engaging means of the fixed legs.

The spigot 16 in FIG. 4 includes a travel limit ring 33 to limit articulation displacement of the mechanism in one direction. A similar ring can be provided above the interconnection means 8, or the distance between the plate 15 of the locating means and the sleeve or body of the interconnection means can be designed to provide a travel limit for articulation of the mechanism in the opposite direction. This travel limit can be used as the sole travel limit or in combination with the slot length travel limit described for FIGS. 1 and 2. Alternatively the flexibility of the support members could only permit a limited travel, or no travel limit need be provided. If no travel limit is provided, the table top could be easily lifted off the mechanism for moving or storing the table, either by making the joints or connections between the top support portions and the table top detachable, or by permitting the table top to rest on the top support portions with no additional fixing.

While FIGS. 1 and 2 show a typical fabricated construction of the mechanism, the interconnection means in FIGS. 3 and 4 is of a more readily cast design. In FIGS. 3 and 4 the fixed legs are fitted into the interconnection means. This assembly design can reduce the shipping size of the unassembled mechanism and can allow for different leg designs (shapes, lengths) to be chosen. There may be an adapter between each leg and the interconnection means to allow legs of different cross-sections to be used.

The ground engaging means (4*c*, 6*c*) of the moveable legs do have a lateral component of their displacement relative to the fixed legs so providing a low friction foot material or profiling the ground engaging means to be rounded in line with the leg pivot can aid operation of the mechanism.

The support mechanisms can be limited to the parts between the locating means and the beam portions of the legs. For example this basic support mechanism (say the parts from FIG. 1) could be sold to companies requiring the functionality, but who want to provide their own table tops and downwards extending leg portions to suit various styles and applications. The use of the mechanism is not limited to support of table tops, it could be integrated into or used to support other items of furniture or white goods for example. If the mechanism were used to support a cupboard for example, the locating means would be fixed to the underside of the cupboard and the ground engaging means could be large plastic pads fitted to the ends of the beam portions of the legs.

The basic mechanism could be supplied with the plate 15 of the locating means increased in size to incorporate the mounting of the top support portions of the support members. Alternatively, the basic mechanism can include a large plate to which the locating means and the top support portions are connected. That plate then provides a platform to which any object can be mounted.

While in the figures the legs are perpendicular to each other in plan view and form a cross in plan view, asymmetric designs are possible. The footprint of the ground engaging means is not limited to being square as shown and the two legs in each pair do not need to be aligned with each other, although any offset of the moveable legs can require a change to the top support portion. Similarly, while the pivot axes of the moveable legs are shown parallel to the major axis of the fixed legs and perpendicular to the major axis of the moveable legs in plan view, although this constraint is not essential, if the pivot axes of each moveable leg is not perpendicular to the major axis of that leg in plan view a change can be required to the top support portion.

The invention claimed is:

1. A support mechanism for an object, the support mechanism including at least two fixed legs, at least two moveable legs and an interconnection means for interconnecting the at least two fixed legs and the at least two moveable legs, each leg including a ground engaging means for providing a point or area of contact between the respective leg and the ground, the at least two fixed legs together including a first and a third leg, the interconnection means being rigidly connected to the at least two fixed legs and being intermediate the at least two fixed legs, the at least two moveable legs together including a second and a fourth leg, each moveable leg including a beam portion, one end of the beam portion of each of the moveable legs being connected to the interconnection means by a respective pivot having a pivot axis, and each moveable leg further including at least one support member connected to the beam portion and extending from the beam portion, at least one object support portion being provided on each support member, the object support portion being in contact with the object in use and providing a substantially vertical support force to the object, locating means attached to the object and located relative to the interconnection means to permit relative displacement between the object and the interconnection means in a substantially upward direction and to prevent relative displacement between the object and the interconnection means in a substantially horizontal direction, such that substantially vertical displacement of the ground engaging means of one of the moveable legs relative to the fixed legs causes substantially vertical displacement of the support member of the associated moveable leg and therefore substantially vertical displacement of the object and the locating means relative the interconnection means and the fixed legs, causing another of the at least two moveable legs to rotate, the support mechanism thereby conforming to the uneven ground.

2. A support mechanism as claimed in claim 1 wherein the interconnection means includes a substantially vertical sleeve and the locating means includes a substantially vertical protrusion or spigot slidably received in the sleeve.

3. A support mechanism as claimed in claim 1 wherein the interconnection means includes a substantially vertical protrusion and the locating means includes a substantially vertical sleeve slidably located around the protrusion of the interconnection means.

4. A support mechanism as claimed in claim 1 wherein each support member is flexible in a substantially horizontal direction to accommodate relative lateral motion between the object and the beam portion of an associated leg, and wherein each support member is substantially rigid in a vertical direction to provide support of the object relative to the beam portion.

5. A support mechanism as claimed in claim 1 wherein motion of each object support portion relative to the object is permitted in a lateral direction perpendicular to the pivot axis of the respective leg and limited in a lateral direction parallel to the pivot axis of the respective leg by a pin and slot mechanism.

6. A support mechanism as claimed in claim 5 including a travel limit between the object support portion of each support member and the object, the travel limit being defined by at least one end of the slot of the pin and slot mechanism, thereby limiting the rotation of at least one moveable leg and providing a travel limit to the support mechanism.

7. A support mechanism as claimed in claim 1 including a travel limit between the interconnection means and the locating means to provide a physical limit to the relative displacement between the locating means and the interconnection means in a substantially vertical direction, thereby limiting the rotation of each moveable leg and limiting warp travel.

8. A support mechanism as claimed in claim 1 wherein at least one leg interferes with the object when warp displacement of the mechanism exceeds a predefined magnitude, said interference providing a travel limit to limit articulation of the support mechanism.

9. A support mechanism as claimed in claim 1 wherein each leg includes a downwards extending portion, extending downwards to the respective ground engaging means.

10. A support mechanism as claimed in claim 1 wherein each fixed leg includes a beam portion, the beam portion of each leg including a first end and a second end, the first end of the first and third legs being fixed to the interconnection means, the first end of the second and fourth legs being connected to the interconnection means by the pivot.

11. A support mechanism as claimed in claim 10 wherein the beam portion of each leg is substantially horizontal in use.

12. A support mechanism as claimed in claim 10 wherein the second end of the beam portion of each leg is connected to the ground engaging means and the at least one support member of each moveable leg is connected to the beam portion of the respective moveable leg between the first and second ends.

13. A support mechanism as claimed in claim 10 wherein the second end of the beam portion of each moveable leg is connected to the at least one support member of the respective moveable leg and the ground engaging means is connected between the first and second ends of the beam portion of the respective moveable leg.

14. A support mechanism as claimed in claim 10 wherein the beam portions of the first and third legs are substantially parallel to each other in use and where the second and fourth leg beam portions are substantially parallel to each other and substantially perpendicular to the first and third leg beam portions in plan view.

15. A support mechanism as claimed in claim 10 wherein the beam portions of the legs form a cross in plan view and where the pivot axes of the second and fourth legs are parallel to the beam portions of the first and third legs in plan view.

16. A support mechanism as claimed in claim 1 wherein the object is a table top.

17. A support mechanism as claimed in claim 1, the object including a table top with each leg including a downwards extending portion, extending downwards to the respective ground engaging means, the second and fourth legs each including the at least one respective support member connected to the respective beam portion and extending at least laterally from the beam portion, at least one top support portion being provided on each support member, the top support portion providing a substantially vertical support force to the table top, and the locating means fixed to the table top and slidably located relative to the interconnection means to permit the relative displacement between the table top and the interconnection means in a substantially vertical direction relative to the interconnection means and to prevent the relative displacement between the table top and the interconnection means in a substantially horizontal direction relative to the interconnection means.

* * * * *